US011713597B2

(12) United States Patent
Parsons et al.

(10) Patent No.: US 11,713,597 B2
(45) Date of Patent: Aug. 1, 2023

(54) PERSONAL RESTRAINTS WITH BUTTON DOUBLE LOCK

(71) Applicant: Armament Systems and Procedures, Inc., Appleton, WI (US)

(72) Inventors: Kevin Parsons, Appleton, WI (US); Siu Ngai Wang, Kowloon (HK)

(73) Assignee: Armament Systems and Procedures, Inc., Appleton, WI (US)

( * ) Notice: Subject to any disclaimer, the term of this patent is extended or adjusted under 35 U.S.C. 154(b) by 205 days.

(21) Appl. No.: 17/133,016

(22) Filed: Dec. 23, 2020

(65) Prior Publication Data

US 2022/0195756 A1 Jun. 23, 2022

(51) Int. Cl.
*E05B 75/00* (2006.01)
*E05B 15/00* (2006.01)

(52) U.S. Cl.
CPC ..... *E05B 75/00* (2013.01); *E05B 15/0046* (2013.01)

(58) Field of Classification Search
CPC ..... E05B 75/00; E05B 15/0046
See application file for complete search history.

(56) References Cited

U.S. PATENT DOCUMENTS 1,855,687 A * 4/1932 Neal ..... E05B 75/00 70/16
2,966,787 A * 1/1961 Tompkins ..... E05B 75/00 70/16
4,509,346 A * 4/1985 Szczepanek ..... E05B 75/00 70/16
5,138,852 A * 8/1992 Corcoran ..... E05B 75/00 70/16
5,660,064 A * 8/1997 Ecker ..... E05B 75/00 70/14
6,672,116 B1 * 1/2004 Hilliard ..... E05B 75/00 70/16
7,062,943 B2 6/2006 Parsons et al.
7,065,990 B2 6/2006 Parsons et al.
2005/0262899 A1 * 12/2005 Parsons ..... E05B 75/00 70/16
2006/0130538 A1 * 6/2006 Wade ..... E05B 75/00 70/16
2006/0162398 A1 * 7/2006 Parsons ..... E05B 75/00 70/16
2007/0193312 A1 * 8/2007 Parsons ..... E05B 75/00 70/16
2011/0259058 A1 * 10/2011 Burgoon ..... E05B 15/0046 70/344
2018/0119459 A1 * 5/2018 Parsons ..... B21J 5/025
2018/0119460 A1 * 5/2018 Parsons ..... E05B 75/00

OTHER PUBLICATIONS

"Clejuso Model 9 High Security Handcuffs" available on the worth wide web at https://www.ebay.com/ltm/Clejuso-Model-9-High-Security-Handcuffs-/274449308583 on Mar. 19, 2021.

* cited by examiner

*Primary Examiner* — Mark A Williams
(74) *Attorney, Agent, or Firm* — Hahn Loeser & Parks LLP

(57) ABSTRACT

Personal restraints are described, including a user-accessible button that can be pushed in sliding a lock bar into a double lock position.

22 Claims, 9 Drawing Sheets

PERSONAL RESTRAINTS WITH BUTTON DOUBLE LOCK

FIELD OF THE INVENTION

The invention generally relates to personal restraints and, in a specific example, handcuffs or ankle cuffs.

BRIEF DESCRIPTION OF THE DRAWINGS

The following drawings illustrate the concepts of the present invention. Illustrations of an exemplary device are not necessarily drawn to scale.

DETAILED DESCRIPTION

Figure 1:
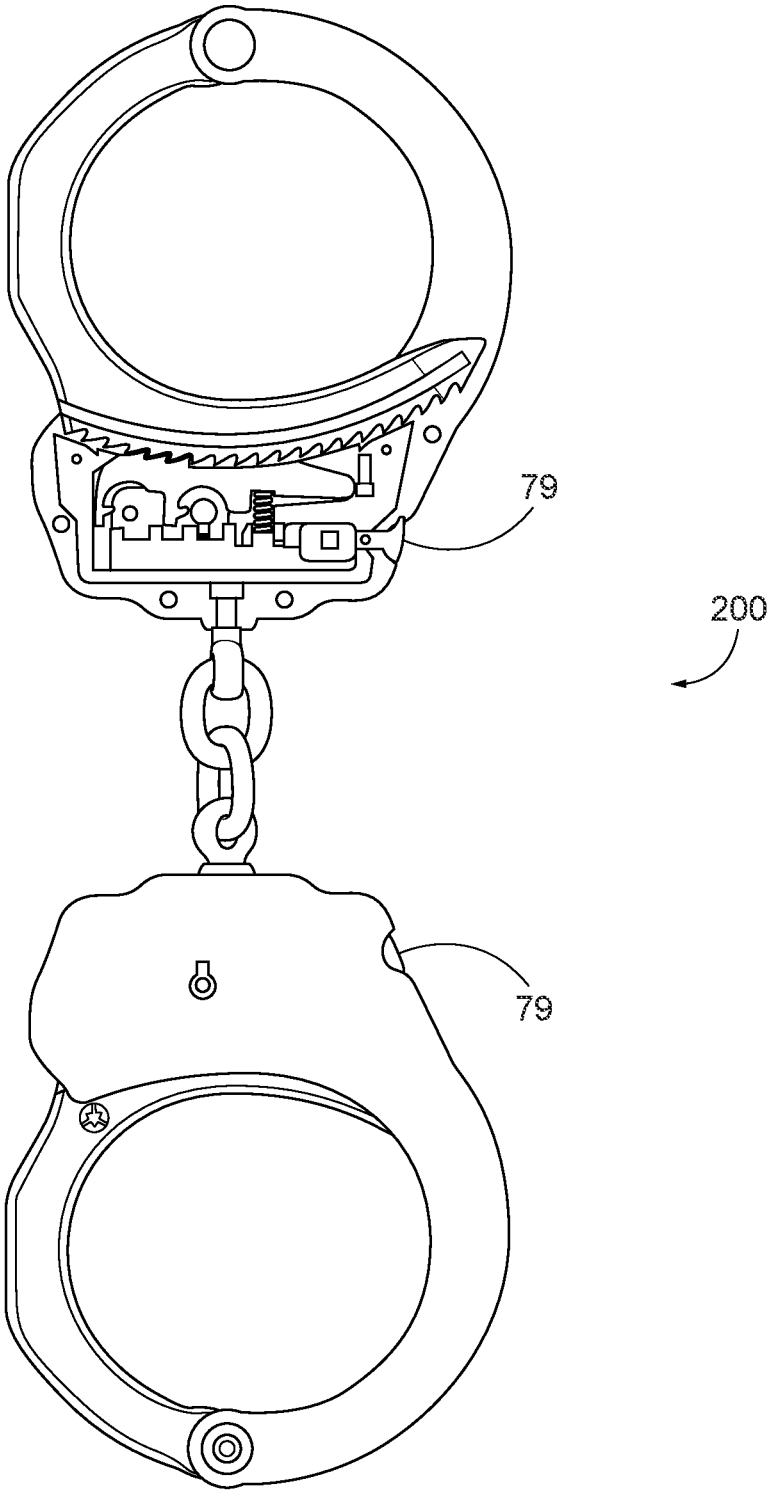
FIG. 1 shows an exemplary pair of chain cuffs with the top cuff showing a cutaway view.
Figure 2:
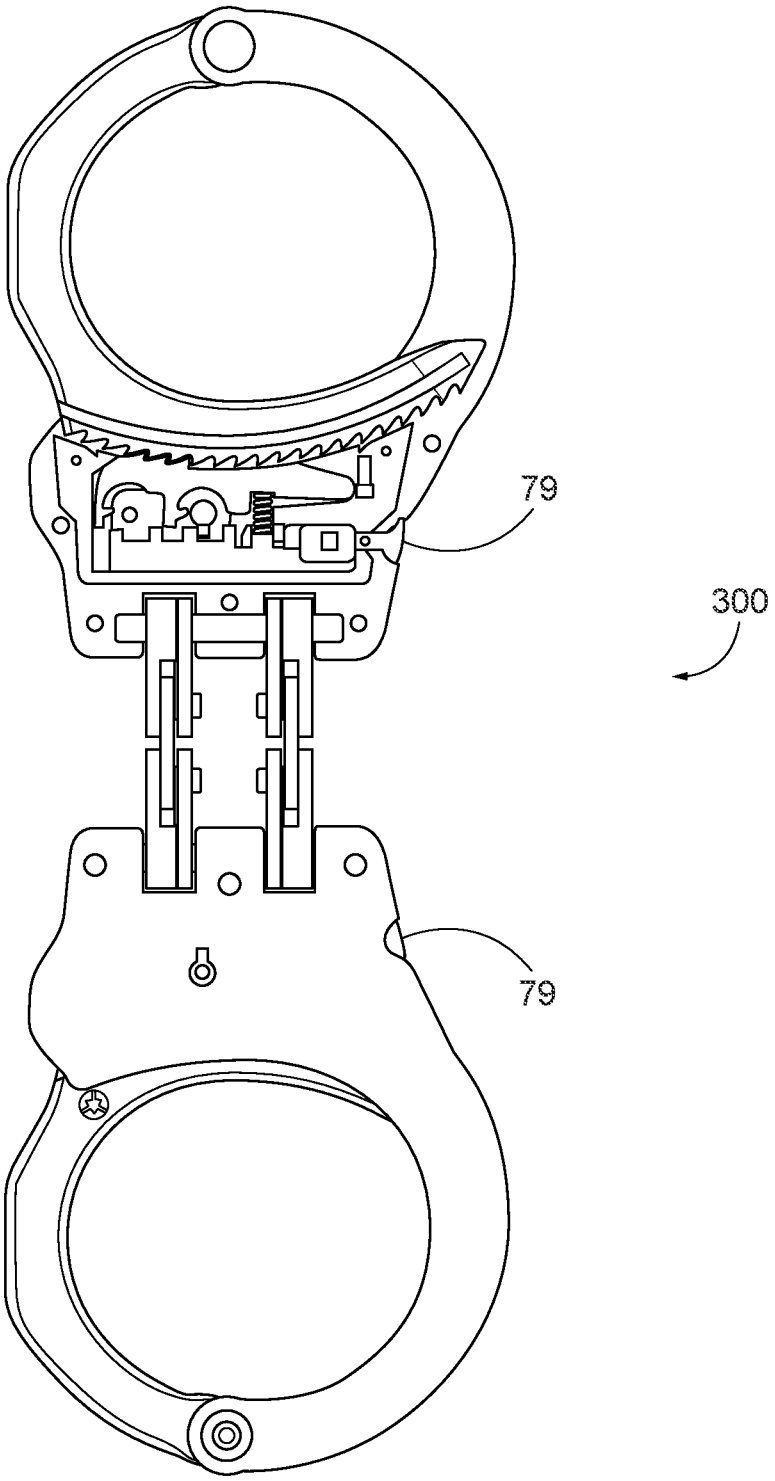
FIG. 2 shows an exemplary pair of hinge cuffs with the top cuff showing a cutaway view.
Figure 3:
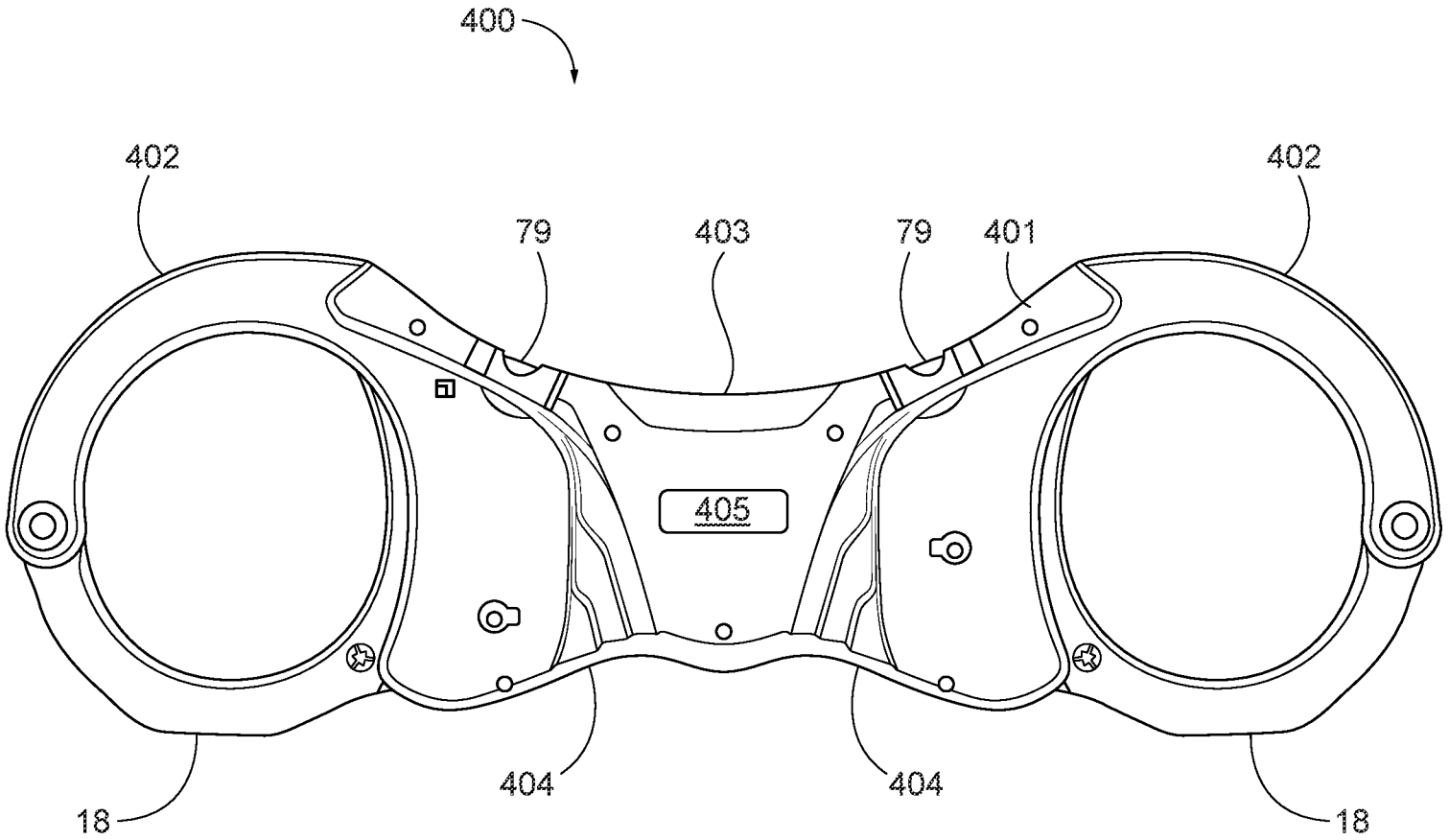
FIG. 3 shows an exemplary rigid pair of handcuffs.

FIG. 1 illustrates an exemplary pair of chain cuffs 200 with the top cuff in the illustration showing a cutaway view. FIG. 2 is a similar illustration of an exemplary pair of hinge cuffs 300. FIG. 3 illustrates an exemplary rigid pair of handcuffs 400.

Among the categories of personal restraints, chain cuffs are the easiest to apply in a confrontational situation because the orientation of each cuff with respect to the other is not fixed. Two chain cuffs typically are joined by a short chain. When used as ankle cuffs the chain would be longer to permit the cuffed subject to walk, and each of two cuffs may have its own chain and the two chains each may be attached to a central ring which also may be attached by a chain or other fetter secured around the cuffed subject's waste or to handcuffs.

Hinge cuffs are more difficult than chain cuffs to apply to a resisting subject, but they provide increased control of the subject. Rigid cuffs provide the most control, and are well suited for courtroom and travel situations.

Figure 4:
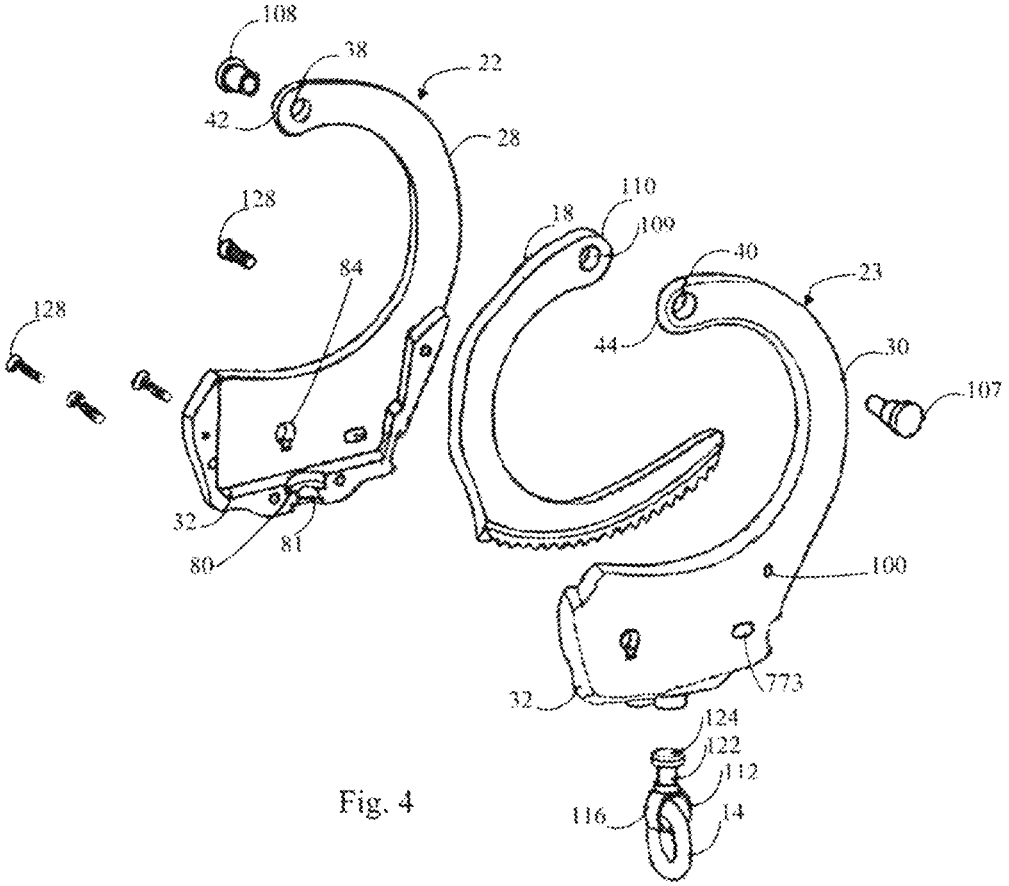
FIG. 4 shows some disassembled components of an exemplary cuff.

The example of FIG. 4 illustrates cheek frame halves 22 and 23 and bow 18. Each cheek frame half 22 or 23 includes a lockset cavity portion 32. Cheek frame halves 22 and 23 are assembled together in a parallel spaced arrangement, and the two lockset cavity portions 32 combine to form a lockset cavity between the two cheek frame halves 22 and 23. A hole 38 or 40 is machined through an outer end 42 or 44 of each cheek arm 28 or 30 for facilitating rotatable mounting of the bow 18 to and between the cheek arms 28 and 30. Outer ends 42 and 44 also may feature a raised surface facing inwards, so that the bow 18 may pivot around the holes 38 and 40 without rubbing on the cheek arms 28 and 30 themselves.

In some embodiments, each cheek frame half 22 and 23 is forged, preferably from an aluminum alloy, such as 7075 aluminum. Such alloys are known for strength comparable to steel while maintaining light weight properties.

In a first step of an exemplary forging process, a round bar of 7075 aluminum alloy is bent into a U-shape to match the general shape of a finished cheek frame half. The bar of aluminum alloy is heated to a forging temperature. The forging temperature is a temperature at which a metal becomes substantially softer, but is lower than the melting temperature. For aluminum alloys, a forging temperature is in the range of 300-480 degrees Celsius.

The curved, heated bar is placed in a die providing the basic shape of the outer surface of a cheek plate half. A corresponding die provides the inner surface of a cheek plate half, and a press strikes the heated bar between the two dies, forging the bar to the shape defined by the dies. The forging is then allowed to cool, and is annealed to soften it. The forging is trimmed to shape with a stamping die that cuts the excess flash from the edges of the forging. The forging may then be heat treated for hardness.

The forging is machined to add all needed holes and detail required by the cheek plate half as described below. It is then sandblasted to give the surface a mat finish. The surface is hard coat anodized for durability and wear resistance.

Advantageously, impression die forging allows for the cheek frame halves 22 and 23 to be fabricated with radiused, curved, rounded, or beveled edges integrally formed during manufacture of the cheek frame halves, without the necessity of separate steps such as post-forging machining or plastic over-molding. The curved, rounded edges are desirable to minimize potential injury to a wrist.

Other embodiments use die cast components, but the forging steps as set forth above provide for precision shaping of the cheek frame halves 22 and 23 while avoiding undesirable brittleness associated with die casting aluminum components.

In the example of FIG. 4, axially spaced-apart keyway openings 84 and 86 are formed in the cheek frame halves 22 and 23, respectively, such that a key can be inserted through one of these keyway openings 84 and 86 from either side of the personal restraint. The forging process allows the keyway openings 84 and 86 to be beveled.

In the example of FIG. 4, a stainless steel pivot pin 107 and a stainless steel pivot bushing 108 are positioned for insertion through holes 38 and 40 in the cheek arms 28 and 30 and a hole 109 in a base end 110 of the bow 18. The pin 107 is swaged, staked or riveted in place.

In some embodiments, the bow 18 is formed from metal powder which is sintered - first subjected to pressure in a mold, and second subjected to heat. Just prior to application of high pressure, some of the metal powder is removed so that rounded edges of 0.040-0.120 inch can be formed, preferably about 0.080 inch. In this way, the bow 18 is made with rounded inner edges for presenting minimal trauma to the wrist of a subject being restrained.

Further, the bow 18 may be polymer infused to inhibit, if not altogether prevent rust or corrosion of the bow 18 and to inhibit, if not to altogether prevent, absorption into the bow 18 of body fluids from a subject being restrained.

Figure 5:
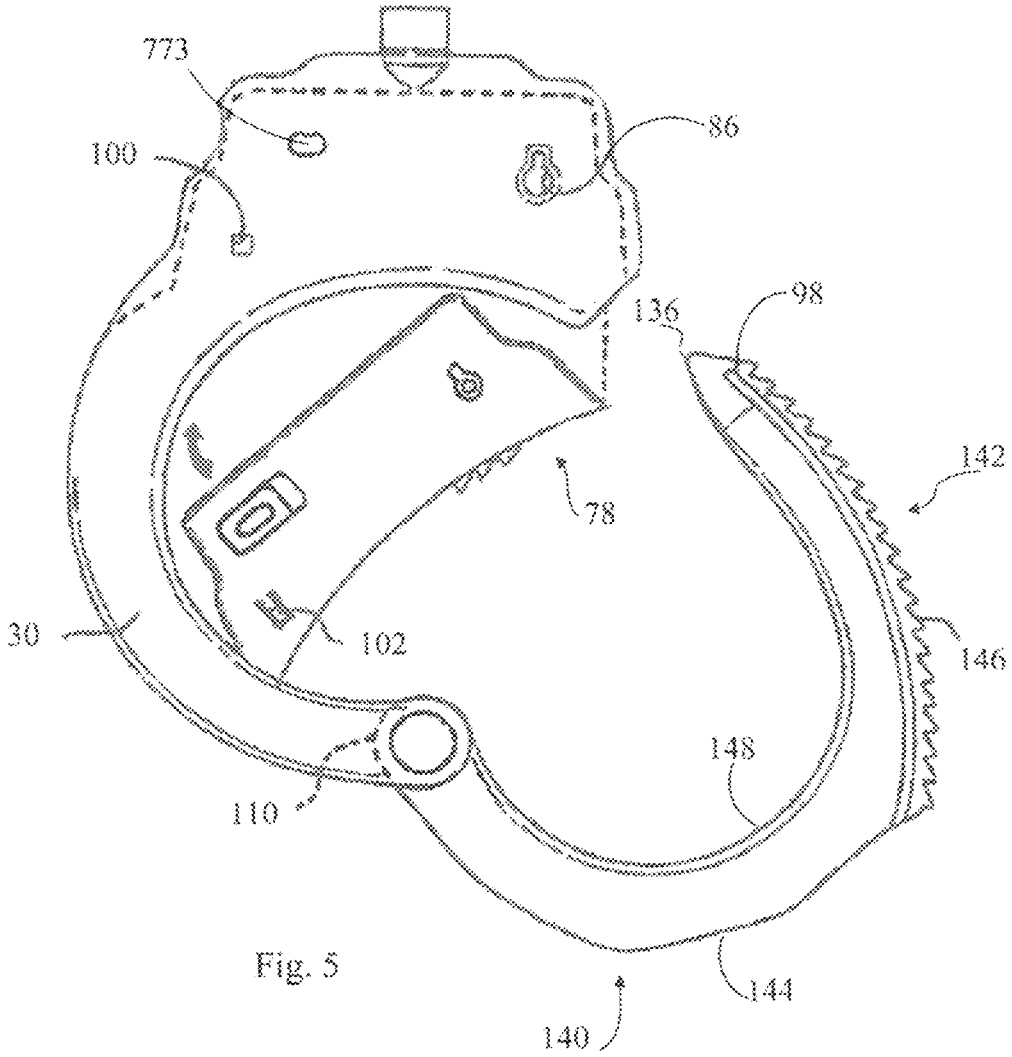
FIG. 5 shows the assembled cuff of FIG. 4 with a lockset assembly that is not inserted into the lockset cavity.

In the example of FIG. 5, the bow 18 includes a first arcuate or curved portion 140 and a second arcuate or curved portion 142 defining a tooth track portion. The first arcuate portion 140 includes the base end 110 with hole 109 therein and has an outer, high contact, flat face 144 against which pressure can be applied to close the personal restraint. The first arcuate portion 140 is designed to be applied against a wrist or an ankle and for pushing the bow 18 between the cheek plate halves 22 and 23. The bow 18 rotates about pivot pin 107 and, absent a wrist or an ankle and absent the lock bar 77 being in the double lock position (discussed below), will continue to rotate full circle. Typically, a personal restraint is initially closed, flat face 144 is pushed against a subject's wrist or ankle so that cheek frame halves 22 and 23 partially surround the wrist or ankle, and bow 18 is rotated full circle so that the wrist or ankle is encircled. The second arcuate portion 142 defines spaced, wide, deep set, ratchet teeth 146 formed on an outer edge thereof.

Additionally, an envelope, formed by an inner edge surface 148 of the bow 18 starting from the base end 110 and extending to the pointed outer end 136, is formed according to a conic path having an increasing arc so as to form an envelope adapted to receive various sized wrists at different positions of the bow 18 relative to the cheek arms 28 and 30 with a minimum of pressure applied to the wrist. Stated otherwise, the conic path of the surface 148 is a curve generated by a projection of a portion of a conic onto a flat plane. The software for generating the design of this conic path is sold by Parametric Technologies Corporation of Needham, Massachusetts under their trademark, Pro/ENGINEER 3-D.

The envelope of the inner edges of the cheek arms 28 and 30 going from the outer ends 42 and 44 having the holes 38 and 40, respectively, to the entry point for the bow 18 into the lockset cavity, also follows a similar or the same conic path having an increasing arc.

In some embodiments, an arcuate track groove 98 is formed on either or both sides of the second arcuate portion 142. A lockset cavity portion 32 can be formed with a track guide 99 (illustrated in example of FIG. 6), for being received in a track groove 98 in the bow 18. The track guides 99 have a rounded configuration for facilitating engagement with the track grooves 98, and facilitate guiding of the bow 18 between cheek frame halves 22 and 23.

Rivets may be used to assemble cheek frame halves 22 and 23. However, the soft metal of the rivets could be a weakness of the personal restraints regardless of how strong the cheek frame halves 22 and 23 are.

In the alternative preferred embodiment of FIG. 4, the cheek frame halves 22 and 23 are assembled together using spiral pins 128 passing through apertures in one cheek frame half and into threads tapped into corresponding apertures in the other cheek frame half. The spiral pins 128 are heat treated for strength and may have tamper-resistant heads. The threads may be treated with thread-locking compound prior to assembly. For example, Loctite brand Red Threadlocker, when cured, requires application of heat to the threads to be disassembled, thereby preventing or at least discouraging attempted disassembly while the handcuffs are being worn by a subject. The use of such fastening means allows for secure assembly in use, but also for disassembly for repair.

Figure 6:
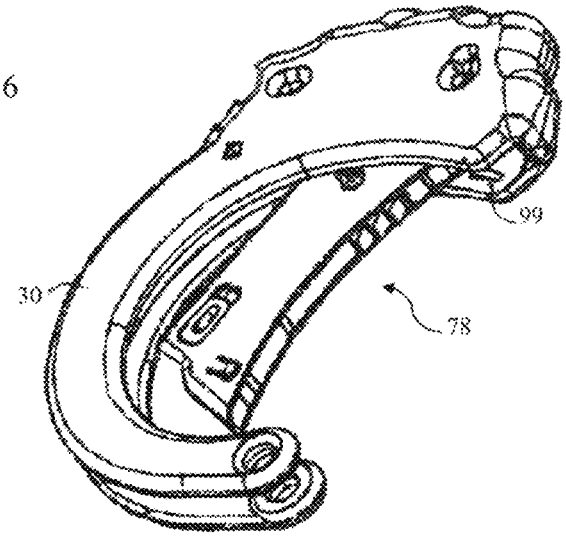
FIGS. 6 and 7 show the cuff of FIG. 5 with the lockset assembly progressively inserted further into the lockset cavity.
Figure 7:
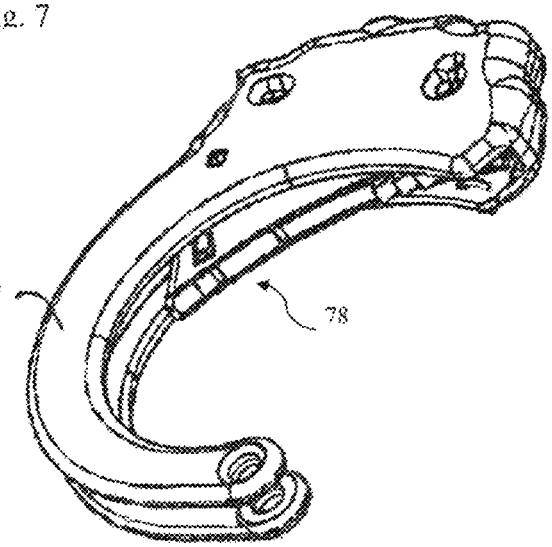

As illustrated in the example of FIGS. 5-7, a latching opening 100 is provided in one of the lockset cavity portions 32, for latching a lockset assembly 78 in a lockset cavity while permitting removal of the lockset assembly 78 from the lockset cavity. The lockset assembly 78 is inserted into the hollow interior of a lockset cavity and rotated until a resilient deflectable latch 102 of the lockset assembly 78 is snap fittingly received into a latching opening 100 in one of the lockset cavity portions 32. The progressive movement of the lockset assembly 78 into the lockset cavity is shown in FIGS. 5-7.

Whenever the lockset assembly 78 ceases to function properly, the lockset assembly 78 can be disengaged from its position within the hollow interior of the lockset cavity by inserting a tool (such as an awl or screwdriver) into the lockset cavity from a position outside of and between the cheek frame halves 22 and 23 while simultaneously time depressing the resilient deflectable latch 102 out of the latching opening 100. The lockset assembly 78 can be pried out of the lockset cavity and replaced. The removal can progress from the position illustrated in FIG. 7, to the position illustrated in FIG. 6, to the fully released position illustrated in FIG. 5. In this way, a lockset assembly 78 can be replaced easily without having to disassemble the first and second cheek frame halves 22 and 23 from each other, and without having to disassemble the bow 18 from its rotatable mounting to the first and second cheek arms 28 and 30. That is, a lockset assembly 78 can be replaced without the need to replace an entire cuff and without the need to disassemble an entire cuff, and similar lockset assemblies 78 can be interchangeable among different types of cuffs such as chain cuffs, hinge cuffs, and rigid cuffs.

Figure 8:
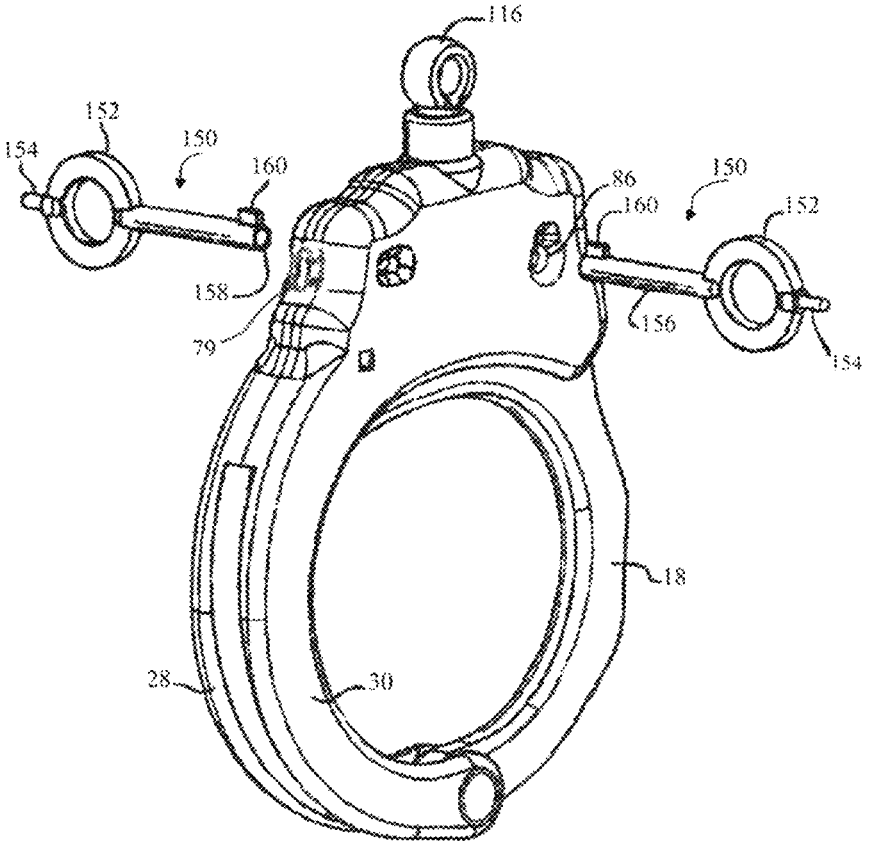
FIG. 8 shows keys being inserted into keyways on each side of the assembled cuff of FIG. 4.

The lockset assembly 78 is constructed for use with a personal restraint key 150 as illustrated in FIG. 8. In the illustrated example, a key 150 includes a handle 152 having a short end pin 154 extending rearwardly from the handle 152 and a shaft 156 extending forwardly from the handle 154 to an outer, hollow cylindrical end 158. On the outer surface of the hollow, cylindrical end 158 is a single projection 160. The end pin 154 can be dimensioned so that it can be used to depress the resilient deflectable latch 102 by inserting end pin 154 through latching opening 100, when removing a lockset assembly 78.

Figure 9:
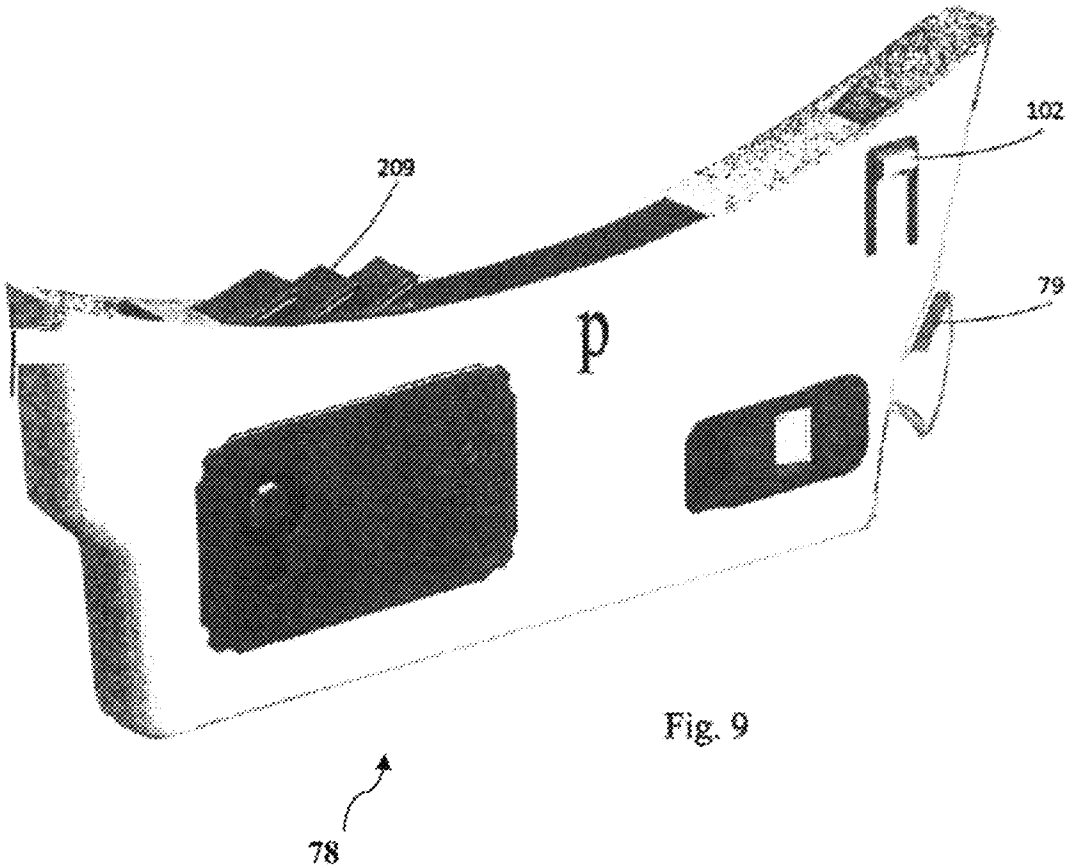
FIG. 9 shows an assembled exemplary lockset assembly with an installed double lock button.
Figure 10:
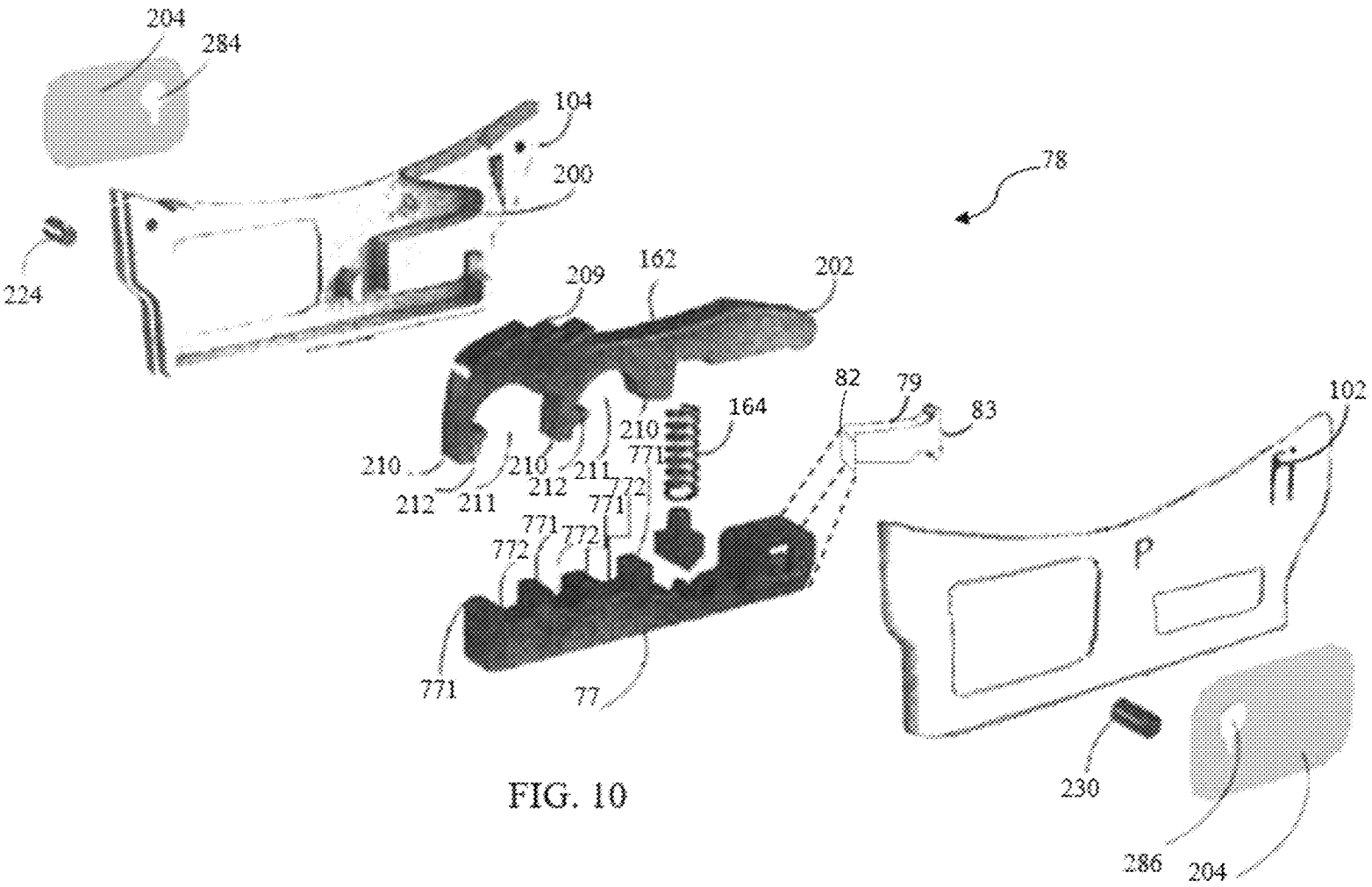
FIG. 10 shows the disassembled components of the lockset assembly and button of FIG. 9.

An exemplary lockset assembly 78 and double lock button 79 are illustrated assembled in FIG. 9 and disassembled in FIG. 10. The principal components include a movable pawl 162, a slidable lock bar 77, and a button 79 that can extend from a distal end of the lock bar 77 out of the lockset cavity to be exposed to a user along combined edges of the first and second cheek frame halves 22 and 23 when the lock bar 77 is not in the double lock position (discussed below).

In the example illustrated in FIG. 10, a housing shell 104 of lockset assembly 78 has a rounded V-shaped cavity 200 into which a rounded end 202 of the pawl 162 extends. This end 202 is rounded for pivoting within rounded cavity 200. An outer edge of the pawl 162 has a plurality of teeth 209 which are constructed, sized and arranged to be received between and mesh with rachet teeth 146 on an outside edge of the second arcuate portion 142 of the bow 18.

In the example illustrated in FIG. 10, two opposing sides and one edge of lock bar 77 are generally smooth for facilitating sliding movement adjacent wall surfaces of the housing shell 104. The opposing edge of lock bar 77 faces an inner edge of pawl 162, and comprises four generally parallel projections 771 separated by spaces 772. The inner edge of pawl 162 comprises three projections 210 separated by spaces 211. Two of the projections 210 include ledges 212 extending into respective spaces 211.

In the example of FIG. 10, parallel key pins 224 and 230 extend, respectively, from opposing wall portions 204 of the lockset assembly 78. Key pin 224 extends along a first axis in line with a keyway 286 that is arranged to be aligned with keyway opening 86 in cheek frame half 23. Key pin 230 extends along a second axis in line with a keyway 284 that is arranged to be aligned with a keyway opening 84 in cheek frame half 22.

A key 150 can be inserted through either keyway opening 84 or 86 (that is, from either side of the personal restraint) with the hollow cylindrical end 158 of the key 150 then being received over the key pin 230 or 224, respectively, and with the projection 160 of the key 150 being in one of the spaces 211 between two pawl projections 210. Key pins 224 and 230 are useful, not only for positioning a key 150, but also for making it harder to insert something into a keyhole and to manipulate the lock.

In the example of FIG. 10, a distal end of the button 79 extends out of the lockset cavity and is exposed to a user along combined edges of the first and second cheek frame halves 22 and 23, when the lock bar 77 is not in a double lock position, so that the user may push in the distal end of the button 79 sliding the lock bar 77 into the double lock position.

In the example of FIG. 10, the button 79 is attached directly to one end of the lock bar 77. In that example, the button 79 has an attaching end 82 opposite a distal end 83. The attaching end 82 comprises an attachment mechanism structured to mate directly with one end of the lock bar 77 so that pushing in the distal end 83 of the button 79 causes the lock bar 77 to slide into the double lock position. Examples of such an attachment mechanism include hooks, loops, projections, recessions, and similar mechanisms.

In the example of FIG. 10, the button 79 is installable and removable while the lockset assembly 78 is disposed in the lockset cavity. This facilitates and simplifies manufacture of a personal restraint in which the lockset assembly 78 can be replaced easily without having to disassemble the first and second cheek frame halves 22 and 23 from each other and without having to disassemble the bow 18 from its rotatable mounting to the first and second cheek arms 28 and 30. The button 79 can be unattached from the lock bar 77 by inserting a tool (such as an awl or the end pin 154 of a key 150) through a button release opening 773 (as seen n FIGS. 4 and 5, for example).

In the example of FIG. 10, the distal end 83 of the button 79 is flared out, relative to a remainder of the button 79, in opposing directions that are substantially perpendicular to a longitudinal axis of the button 79. This makes it harder to insert something next to the button 79 and to manipulate the lock.

In the example of FIG. 10, when the lock bar 77 is in the double lock position, at least one of the projections 771 of the lock bar 77 abuts a respective projection 210 of the inner edge of the pawl 162, preventing movement of the pawl 162 about its rounded end 202, and preventing rotation of the bow 18 if the rachet teeth 146 are engaged with the teeth 209 of the pawl.

When the lock bar 77 is not in the double lock position, none of the plurality of projections 771 of the lock bar 77 abuts a respective projection 210 on the inner edge of the pawl 162, and the lock bar 77 does not prevent movement of the pawl 162 or rotation of the bow 18.

In the example of FIG. 10, a spring 164 is disposed between the pawl 162 and the lock bar 77, and the spring biases the pawl 162 to rotate away from the lock bar 77. When the lock bar 77 is in a single lock position and regardless of whether a key 150 is received over one of the key pins 224 or 230, the bow 18 can rotate in a first direction (tightening the personal restraint if it encircles a wrist or an ankle) with the ratcheting teeth 146 of the bow 18 ratcheting over the teeth 209 of the pawl 162 while successively rotating the pawl 162 about its rounded end 202 toward the lock bar 77 and against the biasing of the spring 164. Due to an angle of the ratcheting teeth 146 of the bow 18, the bow 18 cannot rotate in an opposite second direction (opening the personal restraint) if the ratcheting teeth 146 of the bow 18 are engaged with the teeth 209 of the pawl 162.

When the lock bar 77 is in the single lock position and regardless of whether a key 150 is received over one of the key pins 224 or 230, the distal end 83 of the button 79 may be pushed in sliding the lock bar 77 into the double lock position.

In addition, when the lock bar 77 is in the single lock position and a key 150 is received over one of the key pins 224 or 230, the key 150 can be rotated in a double-locking direction. The projection 160 of the key 150 is in, or will enter, a space 772 between two projections 771 of the lock bar 77 and will push one of the projections 771 of the lock bar 77, sliding the lock bar 77 into the double lock position.

When the lock bar 77 is in the double lock position and a key 150 is received over one of the key pins 224 or 230, the key 150 can be rotated in an opening direction, that is opposite the double-locking direction. The projection 160 of the key 150 is in, or will enter, a space 772 between two projections 771 of the lock bar 77 and will push one of the projections 771 of the lock bar 77, sliding the lock bar 77 into the single lock position. Continuing to rotate the key 150 in the opening direction will pass the projection 160 of the key 150 around through a space 211, between two projections 210 of the pawl 162 until the projection 160 of the key 150 engages a ledge 212 on one of the projections 210, rotating the pawl 162 about its rounded end 202 and toward the lock bar 77 against the bias of the spring 164 and out of engagement with the bow 18. This allows the bow 18 to rotate freely in either the first direction or the second direction. Preferably, keyways 284 and 286 and keyway openings 84 and 86 are shaped so that a key 150 cannot be removed from the personal restraint while the projection 160 has engaged a ledge 212.

The advantage of a double lock position, which prevents rotation of the bow 18 in either direction, is that it minimizes the possibility of uses a shim to open the personal restraint. In the single lock position, the bow 18 can be rotated in a direction tightening the personal restraint. As that is done, the ratcheting teeth 146 of the bow 18 ratchet past teeth 209 of the pawl 162. That creates the possibility of inserting a shim, such as a straw from a broom between ratcheting teeth 146 and teeth 209, which might inhibit them from engaging. This could allow the bow 18 to rotate in a direction opening the personal restraint.

A potential disadvantage of some personal restraints, such as all metal cuffs, is that a sliding lock bar can be moved by hitting the personal restraints hard enough on its edge. In a preferred embodiment, lock bar 77 comprises a polymer instead of metal. The polymer lock bar 77 is light enough so that it will not have enough inertia to move within the lockset cavity when the personal restraint is being hit.

In a preferred embodiment, button 79 has a color that contrasts with a color of the cheek frame halves 22 and 23, so that a color contrast is visible if the button 79 is not pushed in. In that way, it will be readily apparent if a personal restraint is not in the double lock position. Additionally, color codes may be used to distinguish, for example, between personal restraints used only for security training purposes and those used in practice, or between personal restraints with different numbers of pawls.

Several of the figures, including FIGS. 4-8 show examples of a personal restraint adapted for use as one of a pair of chain cuffs. One example is the pair of chain cuffs 200 shown in FIG. 1, which shows two cuffs linked together by two chain links. In the example of a chain cuff seen in FIG. 4, each cheek frame half 22 and 23 also includes a plurality of semi-annular recesses 80 and 81 such that when the cheek frame halves 22 and 23 are combined, the respective semi-annular recesses 80 and 81 combine to form annular recesses. The annular recess formed by semi-annular recesses 80 are dimensioned to accept an end portion 124 of a swivel pin 112, and the annular recess formed by semi-annular recesses 81 has a reduced radius relative to recess 80 to accommodate neck portion 122 and capture the end portion 124. The swivel pin 112 is shown mounted by a swivel eyelet 116 on a chain link 14. A low friction bearing type relationship is established between the swivel pin 112 and the recesses 80 and 81, enabling the swivel pin 112 to swivel easily with respect to the cheek frame halves 22 and 23 much like a shaft in a bearing. A roller bearing style mechanism can provide 360° reinforcement of the swivel pin 112 while ensuring smooth, non-binding rotation.

FIG. 2 illustrates a pair of hinge cuffs 300, hinges joining each one of the pair of hinge cuffs to each other. In some examples, a pin and plate link is used to provide rigid alignment.

FIG. 3 illustrates a pair of rigid cuffs 400. The pair of rigid cuffs 400 comprises two side plates 401 (only one side plate 401 is seen in FIG. 3). In addition to the side plates 401, the rigid pair of handcuffs 400 comprises two bows 18 (one for each of the handcuffs), and two lockset assemblies (one for each of the handcuffs). The cheek frame halves are similar to those in embodiments described above. When the two side plates 401 are assembled together, counterpart lockset cavity portions combine to form a lockset cavity for each one of the two handcuffs, for receipt of a lockset assemblies. Similarly, when the two side plates 401 are assembled together, counterpart cheek arms of each one of the two handcuffs are parallel and spaced apart from each other for receipt of a bow 18 that is pivotally attached to a peripheral end of the cheek arms. Two keyways can be disposed in each of the side plates 401, with each keyway being aligned for receiving a key in the lockset assembly of one of two handcuffs. Consequently, each of the two handcuffs can be unlocked using a key inserted through either side plate 401.

Each side plate 401 comprises a cheek frame half 402 of each one of the handcuffs and a middle section 403. In each side plate 401, each of the cheek frame halves 402 is integral with the middle section 403 on opposing ends of the middle section 403, respectively. In some embodiments, each side plate 401 is a single forged component which simplifies the manufacturing process and increases the strength. In preferred embodiments, each side plate 401 is a forged aluminum alloy component. In the illustrated embodiment, the middle section 403 comprises a plurality of reinforced layers 404 of different thicknesses. The reinforced layers 404 of different thicknesses are sturdy and not susceptible to bending where some prior art versions of rigid pairs of handcuffs are often weakest. The rigid pair of handcuffs 400, with the forged aluminum side plates 401, is thinner and lighter, but stronger, than many prior art versions of rigid pairs of handcuffs.

In the example of FIG. 3, the illustrated middle section 403 includes a channel 405. The channel 405 is dimensioned to allow a fetter to pass through the channel 405 or to allow parts of a locking mechanism to pass through the channel 405 to lock the rigid pair of handcuffs 400 to a fetter, such as may be used in transporting a prisoner.

It will be understood that the personal restraints of the present invention can be modified without departing from the teachings of the invention. Accordingly, the scope of the invention is only to be limited as necessitated by the accompanying claims.

What is claimed is:

1. A personal restraint cuff, comprising:

a first cheek frame half including a first cheek arm and a first lockset cavity portion;

a second cheek frame half including a second cheek arm and a second lockset cavity portion, said first lockset cavity portion and said second lockset cavity portion combining to form a lockset cavity between the first and second cheek frame halves when the first and second cheek frame halves are secured to each other;

a bow having outwardly facing teeth along a portion of the bow and the bow being rotatably mounted to the first and second cheek arms; and a lockset assembly removably disposed within the lockset cavity, the lockset assembly comprising:

a movable pawl having a first edge and an opposing second edge, the first edge of the pawl releasably engaging the teeth of the bow when the bow is rotated into engagement with the lockset assembly; and a slidable lock bar facing the second edge of the pawl and having a plurality of projections separated by spaces between them; and a button attached directly to one end of the lock bar, the button being installable and removable from the lockset assembly while the lockset assembly is disposed within the lockset cavity, and a distal end of the button extending out of the lockset cavity and being exposed to a user along combined edges of the first and second cheek frame halves when the lock bar is not in a double lock position, so that the user may push in the distal end of the button, sliding the lock bar into the double lock position;

wherein at least one of the projections of the lock bar abuts a respective projection on the second edge of the pawl when the lock bar is in the double lock position, preventing movement of the pawl and preventing rotation of the bow when the bow is engaged with the lockset assembly; and wherein, when the lock bar is not in the double lock position, none of the plurality of projections of the lock bar abuts a respective projection on the second edge of the pawl, and the lock bar does not prevent movement of the pawl or rotation of the bow.

2. The personal restraint cuff of claim 1, the lockset assembly further comprising:

a spring between the pawl and the lock bar, and biasing the pawl to rotate away from the lock bar; and at least one key pin for receiving and positioning a hollow cylindrical end of a key;

wherein, when the lock bar is in a single lock position and regardless of whether the key is received over one of the at least one key pins, the bow can rotate in a first direction with the teeth of the bow ratcheting over the first edge of the pawl while successively rotating the pawl toward the lock bar and against the biasing of the spring but, due to an angle of the teeth of the bow, the bow cannot rotate in an opposite second direction if the teeth of the bow are engaged with the pawl;

wherein, when the lock bar is in the single lock position and regardless of whether the key is received over one of the at least one key pins, the button may be pushed in sliding the lock bar into the double lock position;

wherein, when the lock bar is in the single lock position and the key is received over one of the at least one key pins, the key can be rotated in a double-locking direction pushing one of the projections of the lock bar and sliding the lock bar into the double lock position; and wherein, when the lock bar is in the double lock position and the key is received over one of the at least one key pins, the key can be rotated in an opening direction, that is opposite the double-locking direction, pushing one of the projections of the lock bar and sliding the lock bar into the single lock position, and can continue to be rotated in the opening direction until it engages a ledge on the second edge of the pawl rotating the pawl toward the lock bar and out of engagement with the bow, allowing the bow to rotate freely in either the first direction or the second direction.

3. The personal restraint cuff of claim 1, the lockset assembly being removable from the cuff without having to disassemble the first and second cheek frame halves from each other and without having to disassemble the bow from its rotatable mounting to the first and second cheek arms.

4. The personal restraint cuff of claim 1, the button having an attaching end opposite the distal end, the attaching end comprising an attachment mechanism structured to mate directly with the one end of the lock bar so that pushing in the distal end of the button causes the lock bar to slide into the double lock position.

5. The personal restraint cuff of claim 4, wherein insertion of a tool through a button release opening in one of the first and second lockset cavity portions can deflect the attaching mechanism and allow removal of the button.

6. The personal restraint cuff of claim 1, the distal end of the button being flared out, relative to a remainder of the button, in at least one direction that is substantially perpendicular to a longitudinal axis of the button wherein the distal end of the button overlaps an exterior of the lockset assembly.

7. The personal restraint cuff of claim 1, the button having a color that contrasts with a color of the cheek frame halves so that a color contrast is visible if the button is not pushed in.

8. The personal restraint cuff of claim 1, the lockset assembly further comprising two pins, each of the two pins for receiving and positioning a hollow cylindrical end of a key; and each of the first and second lockset cavity portions including a keyway that is aligned with one of the two pins, respectively.

9. The personal restraint cuff of claim 1, the lockset assembly further comprising a resilient deflectable latch;

an inside surface of one of the first and second lockset cavity portions includes a latching opening for the resilient deflectable latch to snap into; and insertion of a tool through the latching opening can compress the resilient deflectable latch allowing removal of the lockset assembly from the cuff if the bow is rotated out of engagement with the pawl.

10. The personal restraint cuff of claim 1, each of the first and second cheek frame halves being a forged aluminum alloy component.

11. The personal restraint cuff of claim 1, each of the first and second cheek frame halves being a forged 7075 aluminum alloy component.

12. The personal restraint cuff of claim 1, each of the first and second cheek frame halves being a hard coat anodized forged aluminum alloy component.

13. The personal restraint cuff of claim 1, the lock bar being a polymer component.

14. The personal restraint cuff of claim 1, the first cheek frame half being fastened to the second cheek frame half with a plurality of spiral pins.

15. The personal restraint cuff of claim 14, wherein the spiral pins are set in thread-locking compound.

16. The personal restraint cuff of claim 1, the first and second cheek frame halves further comprising a plurality of semi-annular recesses such that when the first and second cheek frame halves are combined, the semi-annular recesses combine to form annular recesses that are dimensioned to capture an end portion of a swivel pin.

17. A pair of chain cuffs, each one of the pair of chain cuffs being the personal restraint cuff of claim 16, the pair of chain cuffs further comprising:

a pair of swivel pins, an end portion of each one of the pair of swivel pins being captured in the annular recesses of one of the pair of chain cuffs, respectively;

a chain with at least one chain link, the chain joining each one of the pair of chain cuffs to each other, a swivel eyelet of each one of the pair of swivel pins being received on the chain.

18. A pair of hinge cuffs, each one of the pair of hinge cuffs being the personal restraint cuff of claim 1, the pair of hinge cuffs further comprising: at least one hinge joining each one of the pair of hinge cuffs to each other.

19. A rigid pair of handcuffs, each one of the rigid pair of handcuffs being the personal restraint cuff of claim 1, the rigid pair of handcuffs comprising:

a first side plate and a second side plate;

the first side plate comprising the first cheek frame half of each one of the rigid pair of handcuffs and a first middle section, the first cheek frame half of each one of the rigid pair of handcuffs being integral with the first middle section on opposing ends of the first middle section, respectively; and the second side plate comprising the second cheek frame half of each one of the rigid pair of handcuffs and a second middle section, the second cheek frame half of each one of the rigid pair of handcuffs being integral with the second middle section on opposing ends of the second middle section, respectively.

20. The rigid pair of handcuffs of claim 19, each of the first and second side plates being a single forged aluminum alloy component.

21. The rigid pair of handcuffs of claim 19, at least one of the first and second middle sections comprising a plurality of reinforced layers of different thicknesses.

22. The rigid pair of handcuffs of claim 19, further comprising a channel through the first and second middle sections, the channel being dimensioned to allow a fetter to pass through the channel or to allow parts of a locking mechanism to pass through the channel to lock the rigid pair of handcuffs to a fetter.

* * * * *